US006663415B1

(12) United States Patent
Wu

(10) Patent No.: US 6,663,415 B1
(45) Date of Patent: Dec. 16, 2003

(54) ELECTRICAL CONNECTOR ASSEMBLY WITH IMPROVED STRAIN RELIEF

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/215,535

(22) Filed: Aug. 9, 2002

(51) Int. Cl.[7] ..... H01R 13/58

(52) U.S. Cl. ..... 439/460; 439/608; 439/76.1; 439/906

(58) Field of Search ..... 439/460, 469, 439/459, 465, 607, 610, 608, 801, 810, 76.1, 687, 906

(56) References Cited

U.S. PATENT DOCUMENTS 4,195,899 A * 4/1980 Radloff et al. ..... 439/468
4,422,705 A * 12/1983 Kasper ..... 439/473
4,516,822 A * 5/1985 Wolfel ..... 439/468
4,842,547 A 6/1989 Defibaugh et al.
5,021,006 A * 6/1991 Fargeaud et al. ..... 439/469
5,383,796 A 1/1995 Bowen et al.
5,445,538 A * 8/1995 Rodrigues et al. ..... 439/460
6,123,573 A * 9/2000 Savicki, Jr. ..... 439/469

* cited by examiner

*Primary Examiner*—P. Austin Bradley
*Assistant Examiner*—Edwin A. León
(74) *Attorney, Agent, or Firm*—Wei Te Chung

(57) ABSTRACT

An electrical connector assembly comprises a base (10), a cover (20) assembled to the base, a cable (40) and a U-shaped strain relief (50). The base and the cover each define a first and second opening (17, 27). A pair of channels (173) is defined on opposite sides of the first opening. The cable is received in the first and second opening and has a metal shield (43) enclosing thereof. The strain relief has a bight (51), a pair of intermediate portions (52) extending obliquely from opposite lateral sides of the bight, and a pair of legs (54) extending downwardly from bottom ends of the intermediate portions. The strain relief further has a spring tab (53) extending inwardly and electrically contact with the metal shield of the cable. The legs are received in the channels of the base and have two rows of barbs (55) formed on opposite edges engaging with inner surfaces of the channels.

1 Claim, 8 Drawing Sheets

ELECTRICAL CONNECTOR ASSEMBLY WITH IMPROVED STRAIN RELIEF

CROSS-REFERENCES TO RELATED APPLICATIONS

This application is related to U.S. Pat. application with an unknown Serial number, filed on Jul. 30, 2002 and entitled "ELECTRICAL CONNECTOR HAVING A LATCH MECHANISM", which is assigned to the common assignee and which is hereby fully incorporated by reference.

BACKGROUND OF THE INVENTION

1. Field of the Invention

The present invention relates to an electrical connector assembly, and particularly to an electrical connector assembly with an improved strain relief for firmly securing a cable attached thereto.

2. Description of Related Art

When a cable or the like is terminated by an electrical connector, strain relief means are needed to minimize forces put (exerted) on the connections between the cable and the connector. Strain relief of a cable terminated to a connector requires proper compression of the cable and holds the cable firmly.

Referring to U.S. Pat. No. 4,842,547 issued to Defibaugh, et al. on Jun. 27, 1989, a strain relief 30 has a bight 52 and two legs 54, 56 extending therefrom to respective free ends thereof. Each leg 54, 56 include a plurality of barbs 66 formed on opposite edges thereof. As the strain relief 30 is inserted into a connector housing 12 to a predetermined position, the cable 36 is compressed into a remaining space between the strain relief 30 and an abutment surface 32 of the connector housing 12. The barbs 66 are in penetrating contact with engagement surfaces 42, 44 of the connector housing 12. However, the mount of the compression force is difficult to control. When the compression force is too small, the cable may rotate and easy to be pulled out of the connector housing 12.

U.S. Pat. No. 5,383,796 issued to Bowen, et al. on Jan. 24, 1995 discloses another design of a strain relief. Bowen discloses a cable strain relief 56 includes a center section 60 adapted to embrace one side of a cable, and a pair of wing sections 62 extending from the center section 60 and having screw-receiving holes 58 in align with screw posts 38 defined on a connector housing 18. A pair of screw posts 50 assembles to the screw posts 38 and the screw-receiving holes 58 to secure the strain relief 56 and the cable. The Bowen design is relative complicated and this increases the cost of the whole connector. Moreover such design is unfit for high speed applications because it ignores Electro Magnetic Interference shielding of the cable.

It is thus desirable to provide an improved strain relief of an electrical connector assembly to alleviate or even eliminate the above-discussed problem.

SUMMARY OF THE INVENTION

An object of the present invention is to provide an electrical connector assembly with an improved strain relief, the strain relief can provide enough retaining force on a cable for securing the cable to the electrical connector.

To achieve the above-mentioned object, an electrical connector assembly in accordance with the present invention comprises a base, a cover assembled to the base, a cable and a U-shaped strain relief. The base has a first opening at a rear end portion thereof. A pair of channels is defined on opposite sides of the first opening. A connector subassembly comprises an insulative housing received in a front end of the base, a plurality of terminals assembled into the housing. A printed circuit board (PCB) is assembled to the housing and electrically connecting with the terminals. The cover and the base together define an interior space. The cover has a second opening corresponding to the first opening of the base. The first and second openings together define a cable receiving opening. The cable is received in the interior space from the cable receiving opening and has a metal shield enclosing thereof. The strain relief has a bight, a pair of intermediate portions extending obliquely from opposite lateral sides of the bight, and a pair of legs extending downwardly from bottom ends of the intermediate portions. The bight and the intermediate portions each have a spring tab extending inwardly and electrically connect with the metal shield of the cable. Each leg has two rows of barbs formed on opposite edges thereof. The two legs are received in the channels of the base and the barbs interferentially engage with inner surfaces of the channels.

Other objects, advantages and novel features of the invention will become more apparent from the following detailed description of the present embodiment when taken in conjunction with the accompanying drawings.

DETAILED DESCRIPTION OF THE INVENTION

Figure 1:
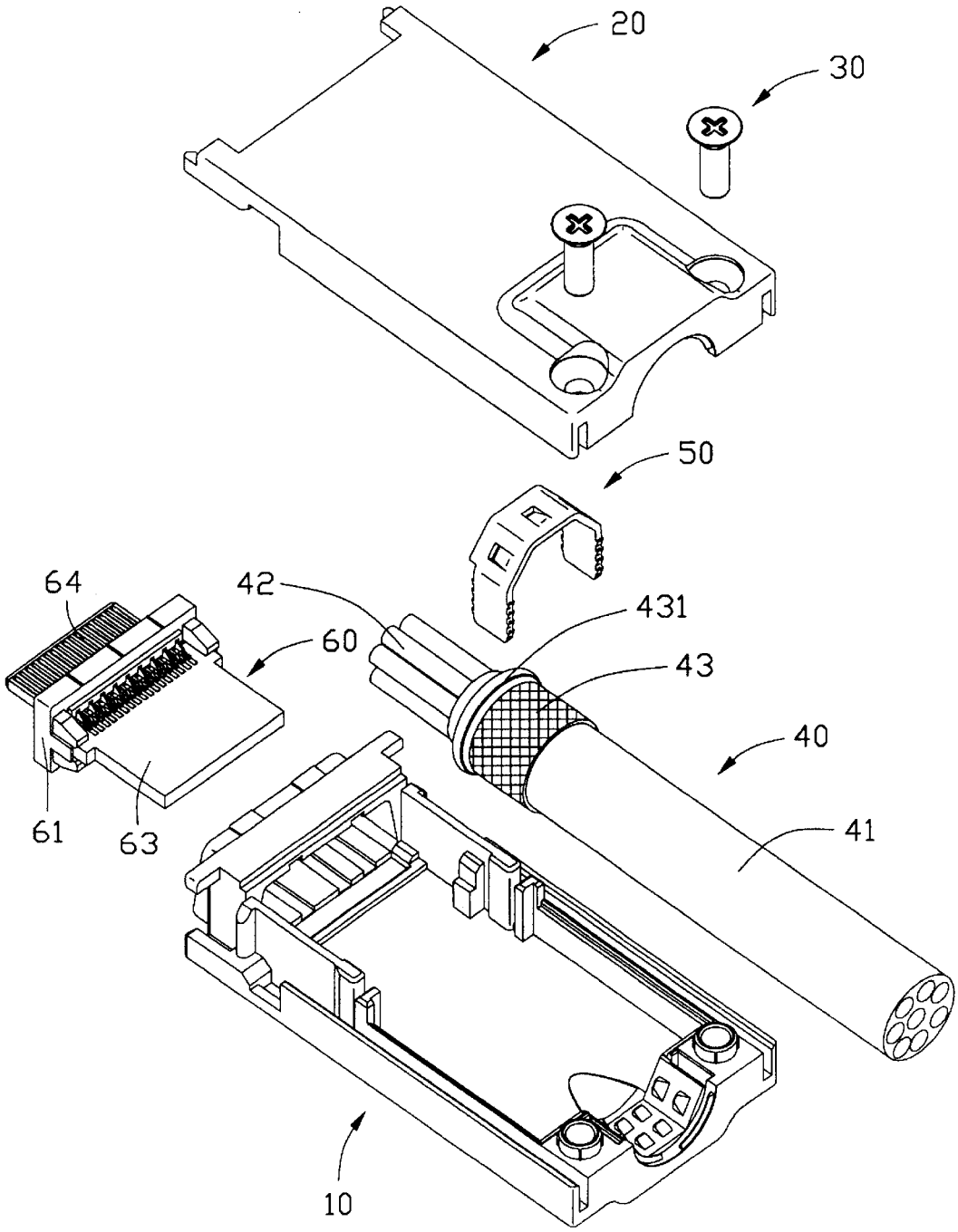
FIG. 1 is an exploded perspective view of an electrical connector assembly in accordance with the present invention.

Referring to FIG. 1, an electrical connector assembly 1 in accordance with the present invention comprises a base 10, a cover 20 for assembled to the base 10, a pair of screws 30 for securing the cover 20 on the base 10, a cable 40, a strain relief 50, and a connector subassembly 60.

Figure 2:
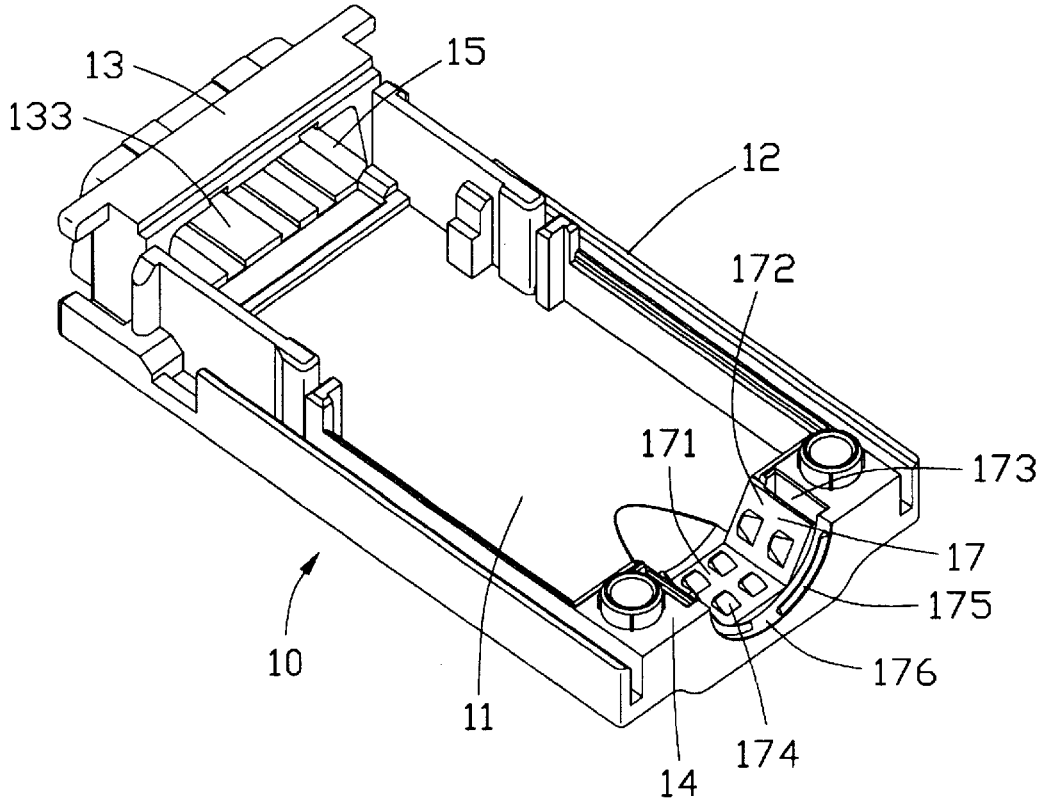
FIG. 2 is an enlarged perspective view of a base shown in FIG. 1.

Referring to FIG. 2, the base 10 comprises a base plate 11 and a pair of sidewalls 12 upwardly extending from opposite lateral sides of the base plate 11. A mating frame 13 is formed on a front end portion 15 of the base 10. The mating frame 13 defines a connector receiving opening 133 through the front end portion 15. The base 10 has a first opening 17 at a rear end portion 14 which is opposite to the front end portion 15. The first opening 17 is defined by a flat bottom wall 171 and a pair of inclined lateral walls 172 connecting opposite lateral ends of the bottom wall 171. A plurality of wedges 174 extends from the bottom wall 171 and the pair of inclined lateral walls 172 into the first opening 17. Front sides of the wedges 174 are higher than rear sides thereof. The rear end portion 14 defines a pair of vertical channels 173, located on opposite lateral sides of the first opening 17. The base 10 has a semicircular shaped flange 176 formed at a rear end of the rear end portion and adjacent to the first opening 17. The flange 176 has two arc-shaped ribs 175 extending inwardly to the first opening 17.

Figure 3:
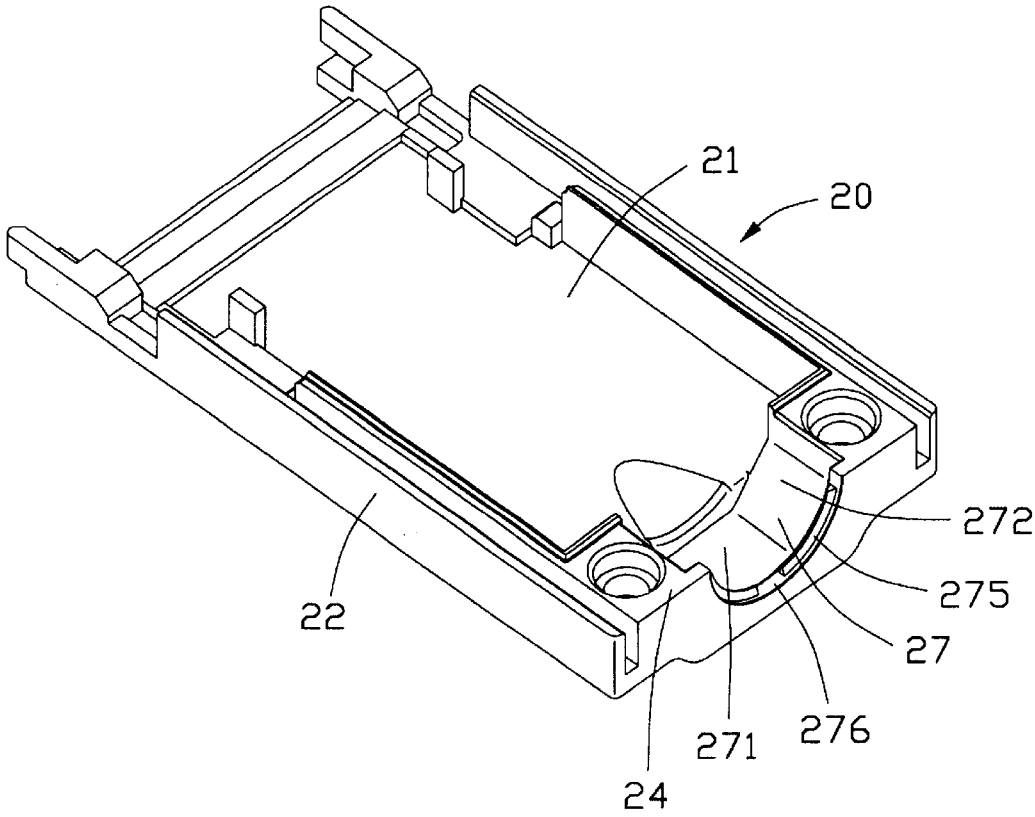
FIG. 3 is an enlarged perspective view of a cover shown in FIG. 1 from a bottom aspect.

Referring to FIG. 3, the cover 20 comprises a cover plate 21 and a pair of sidewalls 22 downwardly extending from opposite sides of the cover plate 21. The cover 20 has a second opening 27 at a rear end portion 24. The second opening 27 is defined by a flat top wall 271 and a pair of inclined lateral walls 272 defined on the rear end portion 24. The pair of inclined lateral walls 272 connects opposite lateral ends of the top wall 271. The cover 20 has a semicircular shaped flange 276 formed at a rear end of the rear end portion 24 and adjacent to the second opening 27. The flange 276 has two arc-shaped ribs 275 extending inwardly to the second opening 27. A more detailed description of the base 10 and the cover 20 can be found in the co-pending application.

Figure 4:
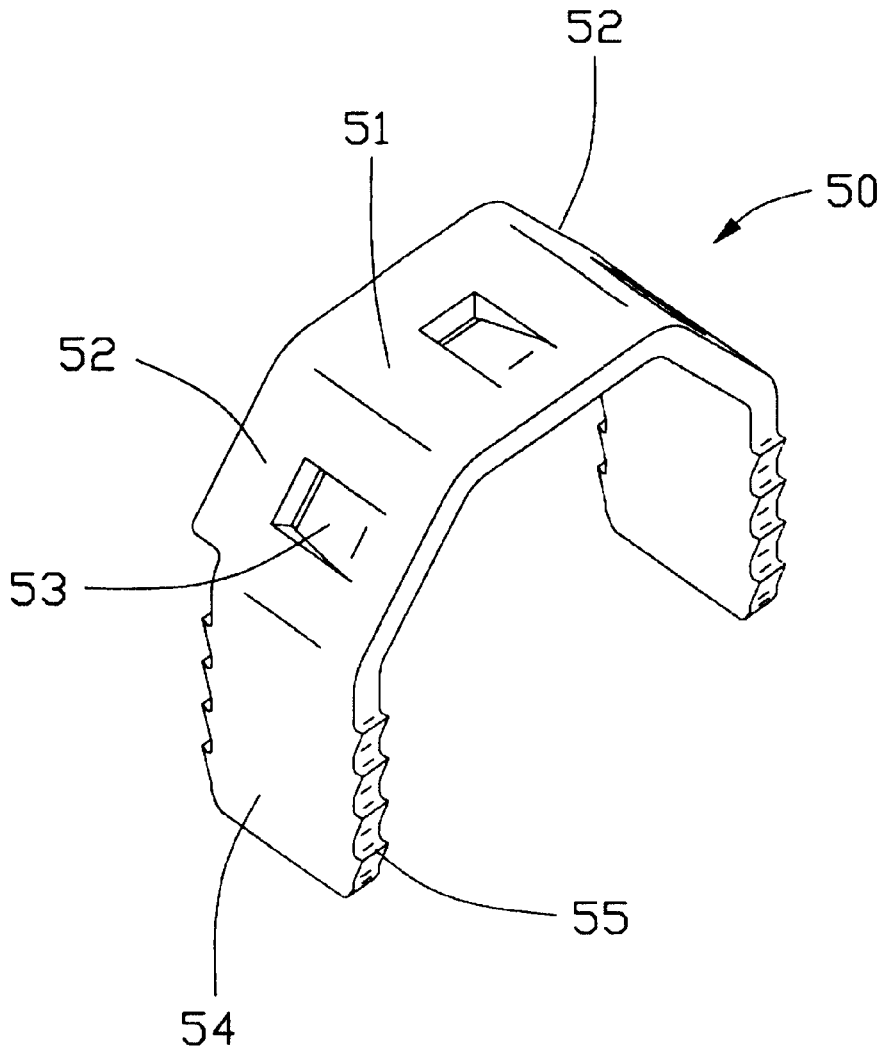
FIG. 4 is an enlarged perspective view of a strain relief shown in FIG. 1.
Figure 5:
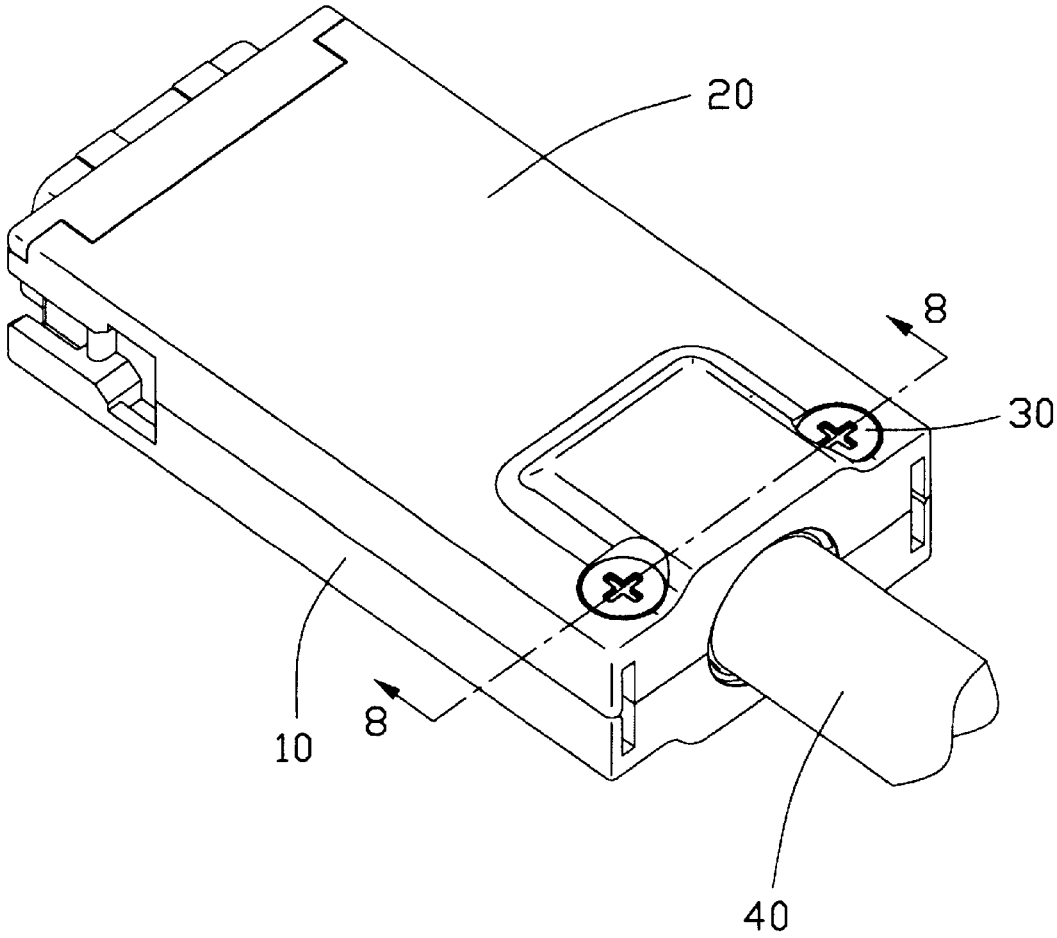
FIG. 5 is an assembled view of the electrical connector assembly shown in FIG. 1.
Figure 6:
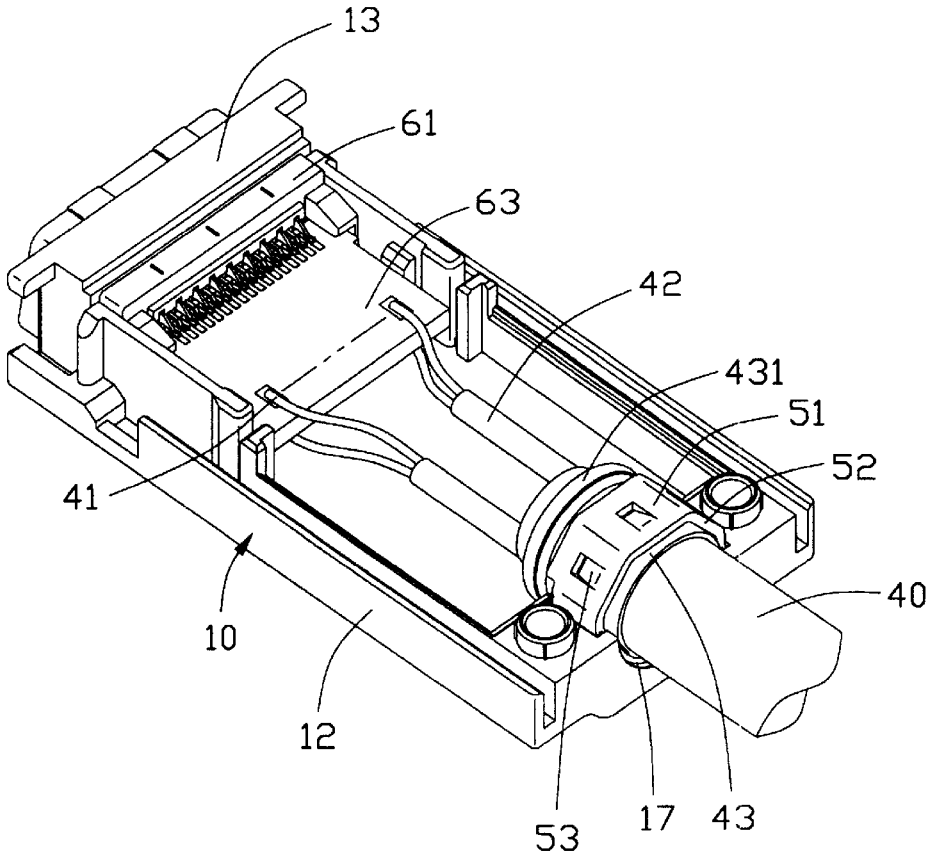
FIG. 6 is a view similar to FIG. 5, with the cover being removed.
Figure 7:
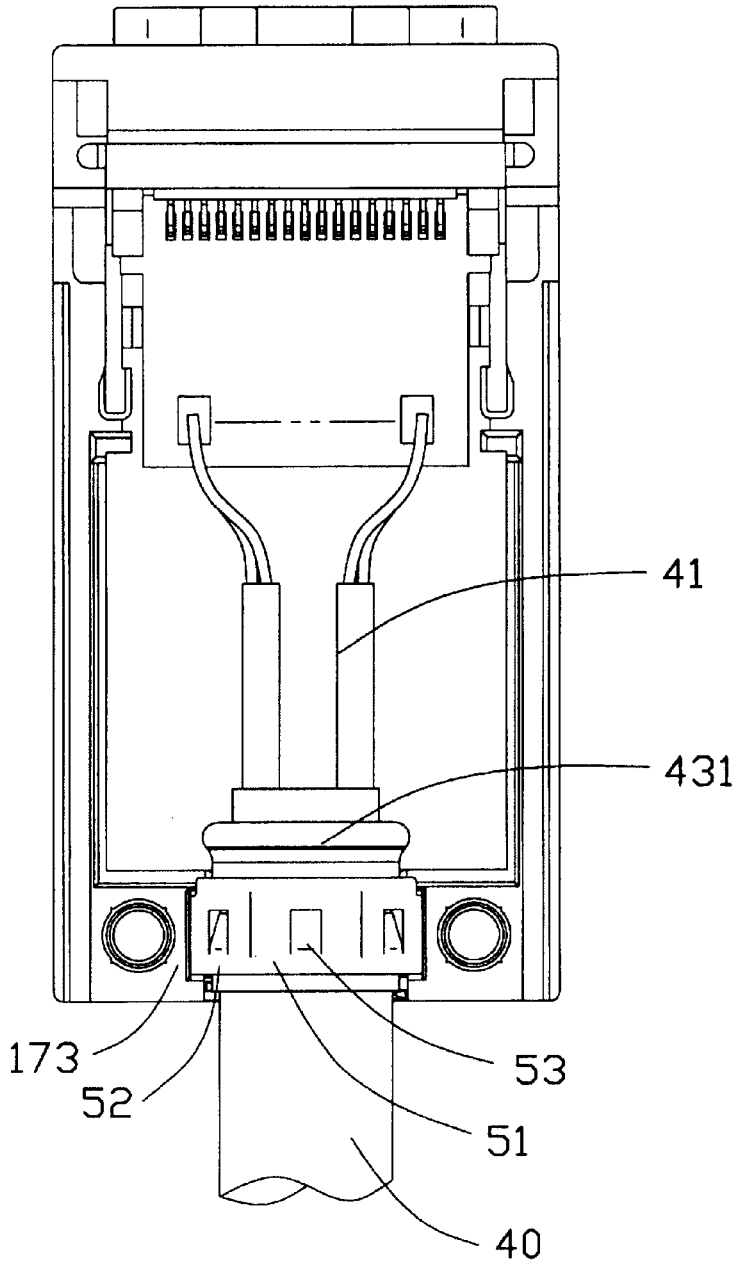
FIG. 7 is a top view of FIG. 6.
Figure 8:
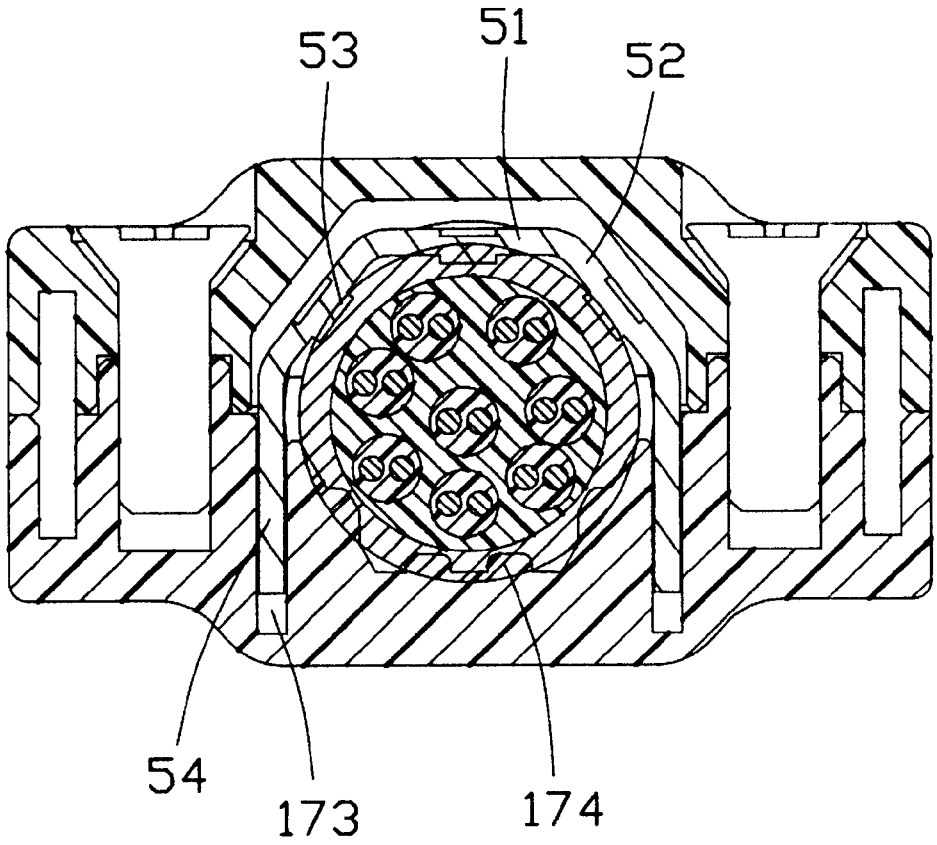
FIG. 8 is a cross-sectional view of the electrical connector assembly taken along a line 8—8 of FIG. 5.

Referring to FIG. 4, the U-shaped strain relief 50 is typically made of electrical conductive material with high rigidity. The strain relief 50 has a bight 51, a pair of intermediate portions 52 extending obliquely from opposite lateral sides of the bight 51 and at an angle of about 45° with the bight 51, and a pair of legs 54 extending downwardly from bottom ends of the intermediate portions 52. The bight 51 and the intermediate portions 52 each have a spring tab 53 punched inwardly. Each leg 54 has two rows of barbs 55 formed on front and rear edges thereof.

Referring to FIG. 1, the cable 40 comprises a plurality of insulated conductors 42 arranged together with a jacket 41 enclosing thereof. The insulated conductors 42 are exposed at one end of the cable 40. A metal shield 43 encloses the jacket 41 adjacent to the exposed portions of the insulated conductors 42. The metal shield 43 has an expended cycle portion 431 formed adjacent to the exposed portions of the insulated conductors 42.

The connector subassembly 60 comprises an insulating housing 61, a plurality of terminals 64 is received in the housing and a printed circuit board (PCB) 63 assembled to a rear end of the housing 61.

Referring to FIGS. 5–8, in assembly, the housing 61 of the connector subassembly 60 is inserted into the mating frame 13 with the PCB 63 positioned between the sidewalls 12. The cable 40 is assembled to the base 10 with the metal shield 43 positioned in the first opening 17 and the insulated conductors 41 electrically connecting with the PCB. The metal shield 43 engages with the wedges 174 and the ribs 176. The expended cycle portion 431 is placed inner side of the rear end portion 14. The strain relief 50 is assembled to the base with the two legs 54 inserted into the channels 173. The barbs 55 engage with inner walls of the channels 173. The bight 51 and the pair of intermediate portions 52 cover on the metal shield 43 with the spring tabs 53 in contact with the metal shield 43. The cover 20 is assembled to the base 10 with the strain relief 50 received into the second opening 27. The bight 51 and the pair of intermediate portions 52 are respectively in contact with the flat top wall 271 and the pair of inclined lateral walls 272. The ribs 175, 275 abut against rear end of the metal shield 43. The screws 30 are assembled to the cover 20 and the base 10 to secure the cable 40 and the strain relief 50 in the cover 20 and the base 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a base having an opening at a rear end portion thereof, a pair of channels being defined on opposite sides of the opening;

a connector subassembly assembled to the base comprising an insulating housing and a plurality of terminals received in the housing;

a cover assembled to the base, the cover and the base together defining an interior space and a cable receiving opening of the interior space;

a cable having a plurality of conductors and an insulated jacket enclosing thereof, the conductors extending into the interior space from the cable receiving opening and electrically connected with the corresponding terminals; and a strain relief having a bight, and a pair of legs extending downwardly from the bight, the strain relief further including a spring tab extending toward the cable, each leg has two rows of barbs formed on opposite edges thereof, the barbs interferentially engage with inner walls of the channels; the cable has a metal shield enclosing thereof, the spring tabs electrically and mechanically contact with the metal shield; the opening of the base is defined by a flat bottom wall and a pair of inclined lateral walls of the rear end portion, the pair of inclined lateral walls connecting opposite lateral ends of the bottom wall; a plurality of wedges extend from the bottom wall and the inclined lateral walls and into the first opening with the wedges in contact with the metal shield of the cable, front sides of the wedges are higher than rear sides thereof; the rear end portion has a number of ribs extending into the first opening adjacent to a rear end thereof, the ribs are in contact with the metal shield of the cable; the cover is defined a second opening together by a flat top wall and a pair of inclined lateral walls of the rear end portion, the pair of inclined lateral walls connect opposite lateral ends of the top wall, the top wall and the inclined lateral walls are in contact with the bight and the intermediate portions of the strain relief; the cover has a number of ribs extending into the second opening adjacent to a rear end thereof and in contact with the metal shield of the cable; the base and the cover are locked by a pair of screws.

* * * * *